US011149983B2

(12) United States Patent
Choi

(10) Patent No.: US 11,149,983 B2
(45) Date of Patent: Oct. 19, 2021

(54) HOT WATER BOILER WITH VORTEX GUIDE

(71) Applicant: Young-Hwan Choi, Seoul (KR)

(72) Inventor: Young-Hwan Choi, Seoul (KR)

( * ) Notice: Subject to any disclaimer, the term of this patent is extended or adjusted under 35 U.S.C. 154(b) by 71 days.

(21) Appl. No.: 16/683,795

(22) Filed: Nov. 14, 2019

(65) Prior Publication Data

US 2020/0080748 A1 Mar. 12, 2020

Related U.S. Application Data

(63) Continuation of application No. PCT/KR2018/002519, filed on Mar. 2, 2018.

(30) Foreign Application Priority Data

Feb. 27, 2018 (KR) ..... 10-2018-0023737

(51) Int. Cl.
*F24H 9/00* (2006.01)
*F24H 7/02* (2006.01)
*F24H 9/18* (2006.01)

(52) U.S. Cl.
CPC ..... *F24H 9/0015* (2013.01); *F24H 7/02* (2013.01); *F24H 9/0042* (2013.01); *F24H 9/1809* (2013.01)

(58) Field of Classification Search
CPC ..... F24H 9/00; F24H 9/18; F24H 7/02; F24H 1/36; F24H 1/282; F24H 1/287; F24H 9/0015
See application file for complete search history.

(56) References Cited

U.S. PATENT DOCUMENTS 1,980,425 A * 11/1934 Morgan ..... F24H 1/43 122/169
3,389,692 A * 6/1968 Johnson ..... F22B 27/14 122/41
6,564,755 B1 * 5/2003 Whelan ..... F24D 12/02 122/20 B
2017/0045310 A1 * 2/2017 Choi ..... F24H 1/36

FOREIGN PATENT DOCUMENTS

JP H05-322303 A 12/1993
KR 10-2004-0021210 A 3/2004
KR 10-2015-0121817 A 10/2015

OTHER PUBLICATIONS

International Search Report issued in PCT/KR2018/002519; dated Nov. 27, 2018.

* cited by examiner

*Primary Examiner* — Steven S Anderson, II
(74) *Attorney, Agent, or Firm* — Studebaker & Brackett PC

(57) ABSTRACT

A hot-water storage type boiler having a vortex guide portion is proposed. Since the present invention includes a spiral portion inside a casing, water supplied into the casing is moved to the upper side of the space part, while being in contact with fire tubes for a long time by moving spirally along the spiral portion, thereby improving heat exchange efficiency of the fire tubes. In addition, since the water supplied into the casing is moved spirally along the spiral portion to form a vortex, the flow of water moving in the direction of a hot-water discharge portion collides with a firebox lower surface part at a high speed, thereby having an effect of preventing scale from accumulating on the firebox lower surface part.

10 Claims, 9 Drawing Sheets

HOT WATER BOILER WITH VORTEX GUIDE

CROSS-REFERENCE TO RELATED APPLICATIONS

This application is a Continuation of International Application No. PCT/KR2018/002519 filed Mar. 2, 2018, which claims benefit of priority to Korean Patent Application No. 10-2018-0023737 filed Feb. 27, 2018, the entire content of which is incorporated herein by reference.

TECHNICAL FIELD

The present invention relates to a hot-water storage type boiler having a vortex guide portion and, more particularly, to a hot-water storage type boiler having a vortex guide portion for efficiently managing scale accumulated in a casing of the boiler.

BACKGROUND ART

In general, gas boilers use gas as fuel and water as heat medium for heating. Especially in the case of a boiler offering both indoor heating and hot water supply, circulation water for heating is circulated inside the boiler through a three-way valve, and the boiler, which is a combustor that heats supply water in a form of indirect heat exchange, enables supply of hot water as well. These gas boilers are classified into instantaneous type boilers and hot-water storage type boilers according to a hot water supplying method.

The instantaneous type boiler is heated by a main heat exchange part or a hot-water heat exchange part in the boiler when needed to supply hot water. Since such an instantaneous type boiler quickly converts cold water into hot water by being instantaneously heated by a large-capacity electric heater, and a separate hot water tank is not used, whereby a small sized boiler may also be hung on a wall. However, in the case of indoor heating and the like using the instantaneous type boiler, there is a problem in that a large amount of electricity is consumed by using the large-capacity electric heater, incurring an excessively high cost for the heating.

The hot-water storage type boiler is designed to store hot water in a separate hot water storage tank so that the hot water may be used instantaneously when needed, which is different from the instantaneous type boiler that operates a burner and generates hot water when needed. The hot-water storage type boiler is configured to be provided with a heat exchange part inside the hot water storage tank so that direct water stored in the hot water storage tank is heated to generate hot water of a suitably high temperature by the heat exchange part. Accordingly, users may instantaneously use the hot water or the water for heating.

FIG. 1 is a view illustrating a conventional hot-water storage type boiler. Referring to FIG. 1, the conventional hot-water storage type boiler 10 includes a heat exchange means 14 having a plurality of fire tubes 14*a* inside a casing 12, a burner part 16 that blows out flames to the heat exchange means 14, an intake part 18 for supplying air to the burner part 16, and an exhaust part 19 for discharging combustion gas generated in the burner part 16 to the outside.

When the direct water is supplied into the casing 12 from the outside, the direct water is in contact with the plurality of fire tubes 14*a* provided inside the casing, and then heat exchange proceeds with hot water. Thus, the hot water generated in this way is supplied to a hot water pipe (not shown) by a circulation pump (not shown).

Meanwhile, when the direct water is in contact with the fire tubes 14*a* or the burner part 16, the heat exchange proceeds. Therefore, when scale is accumulated in the fire tubes 14*a* or the burner part 16, heat exchange efficiency of the fire tubes 14*a* or the burner part 16 is lowered. That is, scale is caused by impurities, such as silica, calcium, or magnesium salts, deposited in the direct water, and the impurities have much lower thermal conductivity than that of copper or steel used to make an external form of the fire tubes 14*a* or the burner part 16. Accordingly, when scale is generated in the fire tubes 14*a* or the burner part 16 due to such impurities, there is a problem in that the heat exchange efficiency of the fire tubes 14*a* or the burner part 16 is lowered. In addition, since scale accumulated in the fire tubes 14*a* or the burner part 16 occupies a volume inside the casing 12, there is a problem of lowering the tap amount of hot water, and corroding the weld joint part between the fire tubes 14*a* and the burner part 16.

DISCLOSURE

Technical Problem

An objective of the present invention for solving the problems of the related art as described above is to provide a hot-water storage type boiler having a vortex guide portion for efficiently managing scale accumulated in a casing.

Technical Solution

In order to achieve the above objective of the present invention, there is provided a hot-water storage type boiler having a vortex guide portion, the hot-water storage type boiler including: a casing having a space part therein and provided with an independent firebox at a position above the space part; a burner injecting flames into the firebox; a plurality of fire tubes having a first side connected to a lower surface of the firebox and a second side extending downward in the space part; the vortex guide portion having a spiral portion spirally provided along a vertical direction of the casing in the space part; and an exhaust part provided at a position below the casing and connected to the fire tubes, wherein the flames injected by the burner are moved along an inside of the fire tubes while heating the fire tubes and then moved to the exhaust part, and water supplied to a first side of the space part moves spirally along the spiral portion and moves to a second side of the space part.

In addition, the spiral portion may be provided spirally around a central passage part provided in a vertical direction in a center of the space part, and the water supplied to a lower part of the space part may be guided in a firebox direction while moving spirally along the spiral portion or guided in the firebox direction along the central passage part.

In addition, an outer side of the spiral portion may be in close contact with an inner circumference of the casing.

In addition, the plurality of fire tubes may be disposed radially, and the spiral portion may be provided with a plurality of fire tube guiding holes to allow the plurality of fire tubes to pass therethrough.

In addition, the vortex guide portion may further include a plurality of support parts having a first side connected to the lower surface of the firebox, and having a second side connected to a lower part of the casing in a state of passing through the spiral portion so as not to be laid over the fire tubes, and the spiral portion may be fixed to the support parts.

In addition, an upper side of the spiral portion may be positioned to be spaced apart from the lower surface of the firebox in a state of being supported by the support parts, a lower side of the spiral portion may be positioned to be spaced apart from the lower part of the casing in the state of being supported by the support parts, and a hot-water discharge portion and a direct water supply part may be respectively provided on upper and lower parts of the casing, in which the hot-water discharge portion may be positioned above the upper side of the spiral portion and the direct water supply part may be positioned below the lower side of the spiral portion.

In addition, a lower surface part of the firebox facing an upper side of the space part may be provided in a multi-stepped-surface shape so as to be spaced apart from an upper surface part of the casing toward a center of the lower surface part of the firebox, a lower surface part of the casing facing a lower side of the space part may be provided in a multi-stepped-surface shape so that a separation distance between the lower surface part of the firebox and the lower surface part of the casing may become same, upper ends of the fire tubes may be configured to pass through the lower surface part of the firebox, and lower ends of the fire tubes may be configured to pass through the lower surface part of the casing.

In addition, an outer circumference of the firebox may be configured to be smaller than the inner circumference of the casing so as to allow a guide space part to be provided between the outer circumference of the firebox and the inner circumference of the casing, and when the water supplied into the space part from an outside may be heated to become hot water by the fire tubes, the hot water heated may be discharged to the outside of the casing after being guided to the guide space part.

In addition, a spiral guiding part may be provided in a spiral shape along the outer circumference of the firebox, and the hot water guided to the guide space part may be discharged to the outside of the casing after moving spirally around the outer circumference of the firebox along the spiral guiding part.

In addition, a plurality of recess parts may be provided along an outer longitudinal direction of the spiral guiding part facing an inner circumferential surface of the casing, and a part of the hot water guided to the guide space part may be discharged to the outside of the casing through the spiral guiding part via the recess parts.

Advantageous Effects

The present invention includes a spiral portion inside a casing, so water supplied into the casing is moved to an upper side of a space part while being in contact with fire tubes for a long time by moving spirally along the spiral portion, thereby improving heat exchange efficiency of the fire tubes.

In addition, since the water supplied into the casing is moved spirally along the spiral portion to make a vortex, a water flow with a speed up moving in a direction of the hot-water discharge portion collides with a firebox lower surface part at a high speed, thereby having an effect of preventing scale from accumulating on the firebox lower surface part.

In addition, a part of the water supplied into the casing passes through a central passage part, in which the water flow with the speed up collides with the firebox lower surface part, so the present invention has an effect of preventing scale from accumulating more.

In addition, the temperature of water passing through the central passage part is lower than the temperature of water moving spirally along the spiral portion. Thus, the relatively cold water temporarily lowers the temperature of the firebox lower surface part when being in contact with the firebox lower surface part, thereby realizing an effect of preventing scale from occurring.

In addition, a guide space part provided between the firebox and the casing is configured to be spiral around the outer circumference of a firebox body by a spiral guiding part, so the hot water heated by the fire tubes moves spirally around the outer circumference of the firebox body along the guide space part. Accordingly, the contact time between the firebox body and the hot water becomes long, thereby improving the heat exchange efficiency of the firebox.

Also, a plurality of recess parts is provided in the spiral guiding part, so the hot water with a relatively low temperature, passing through the spiral guiding part via the recess parts, is mixed with the hot water with increased temperature while moving spirally around the outer circumference of the firebox body along the spiral guiding part. Thus, the present invention is advantageous in that the effect of controlling the rapid temperature rise of the hot water with a high temperature is realized.

DESCRIPTION OF SYMBOLS

Figure 1:
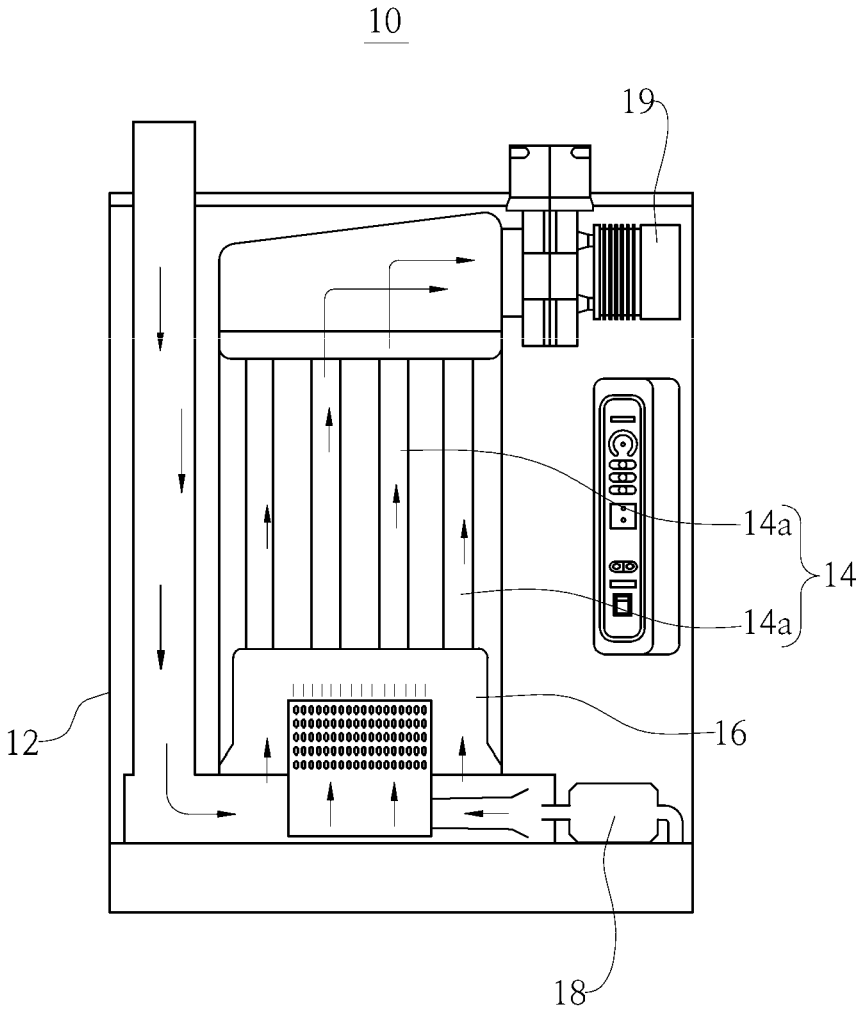
FIG. 1 is a diagram illustrating a conventional hot-water storage type boiler.

50: hot-water storage type boiler
100: casing 105: casing body

110: upper open part 120: casing lower surface part
122: first casing stepped surface part 124: second casing stepped surface part
130: space part 132: first space part
134: second space part 136: third space part
140: guide space part 150: direct water supply part
160: hot-water discharge portion 200: firebox
205: firebox body 210: firebox lower surface part
212: first firebox stepped surface part 214: second firebox stepped surface part
250: spiral guiding part 300: burner
400: vortex guide portion 410: spiral portion
412: fire tube guiding hole 415: central passage part
420: support part 500: fire tube
600: exhaust part

BEST MODE

Hereinafter, a hot-water storage type boiler having a vortex guide portion according to a practical exemplary embodiment of the present invention is described in more detail with reference to the accompanying drawings.

Figure 2:
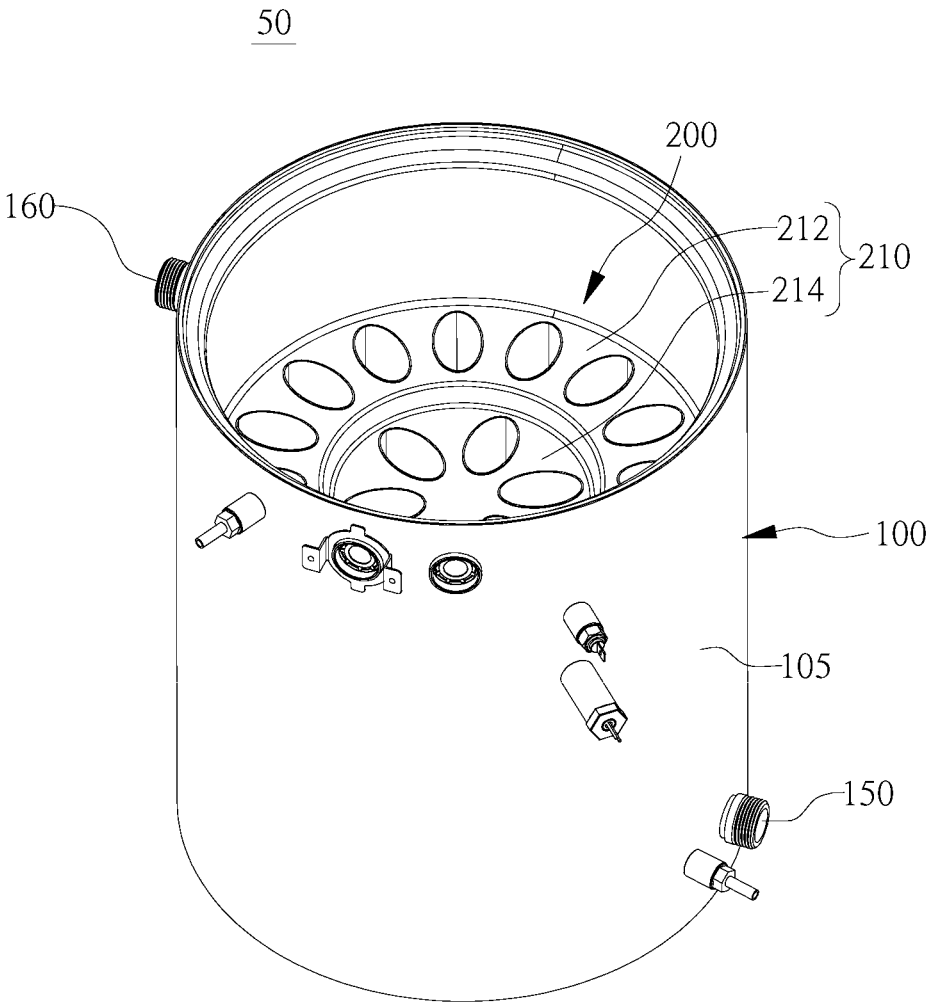
FIG. 2 is a diagram schematically illustrating a top view of a hot-water storage type boiler having a vortex guide portion according to a practical exemplary embodiment of the present invention.
Figure 3:
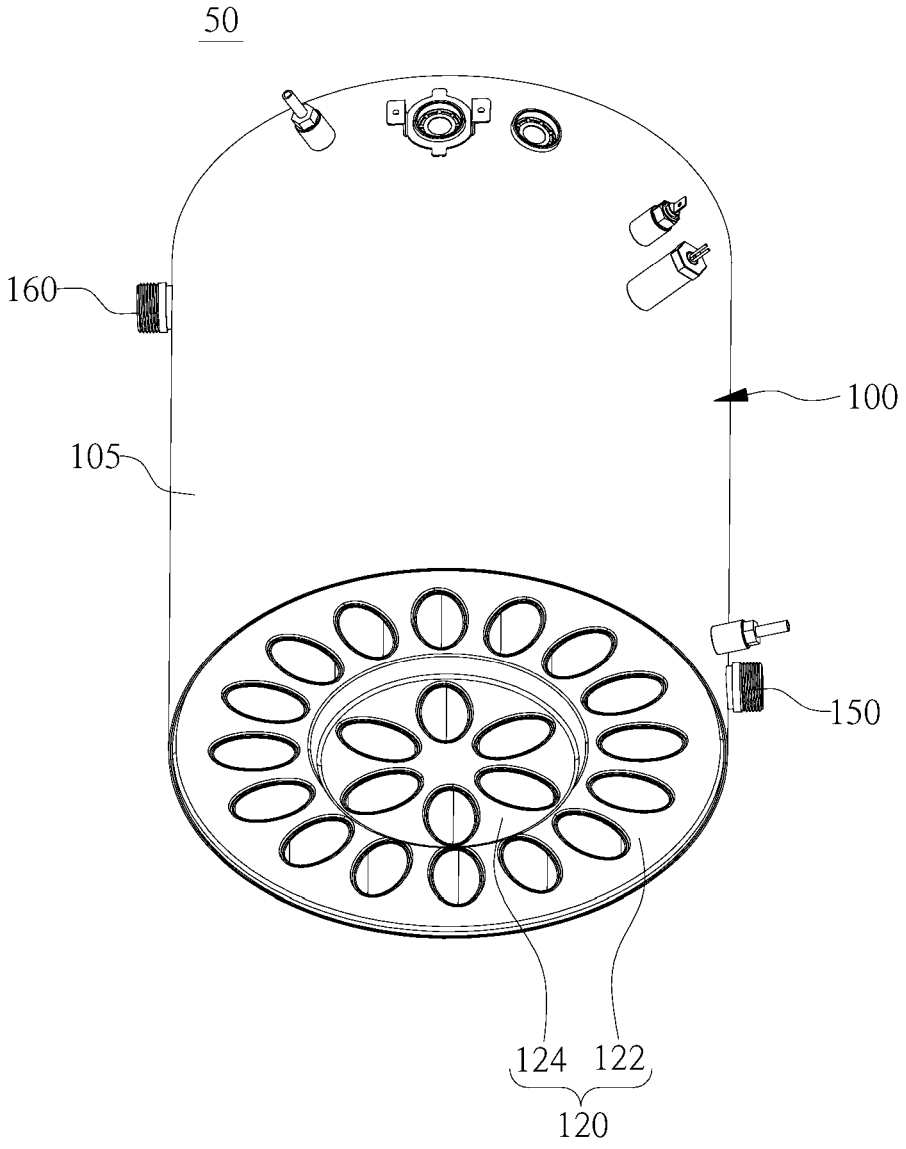
FIG. 3 is a diagram schematically illustrating a bottom view of the hot-water storage type boiler having the vortex guide portion according to the practical exemplary embodiment of the present invention.

FIG. 2 is a diagram schematically illustrating a top view of the hot-water storage type boiler having the vortex guide portion according to the practical exemplary embodiment of the present invention, and FIG. 3 is a diagram schematically illustrating a bottom view of the hot-water storage type boiler having the vortex guide portion according to the practical exemplary embodiment of the present invention.

Figure 4:
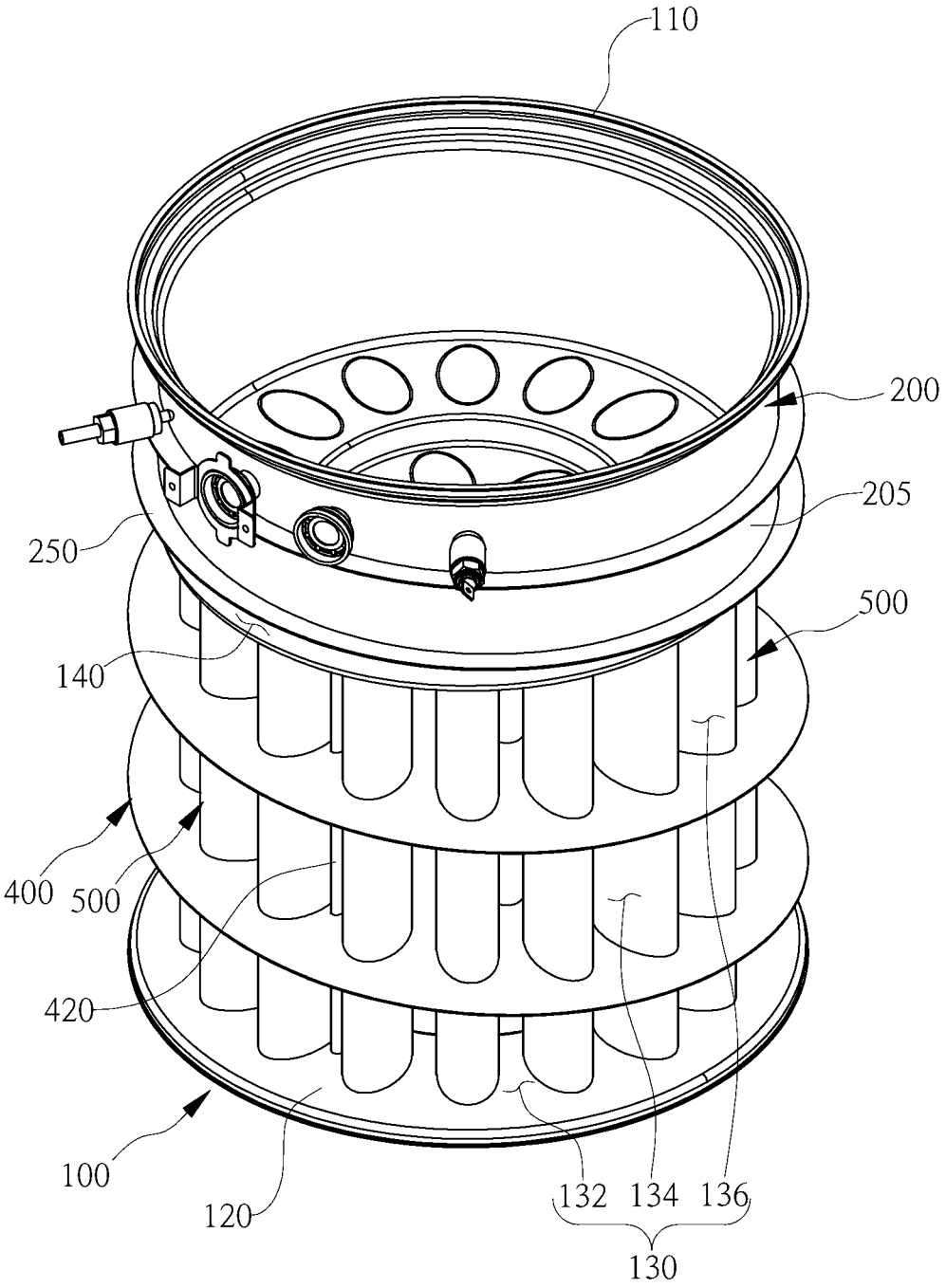
FIG. 4 is a diagram schematically illustrating an inner part of the hot-water storage type boiler having the vortex guide portion according to the practical exemplary embodiment of the present invention.

Referring to FIGS. 2 and 3, the hot-water storage type boiler 50 having the vortex guide portion according to the practical exemplary embodiment of the present invention includes a casing 100, a firebox 200, a burner 300 (shown in FIG. 8), a plurality of fire tubes 500 (shown in FIG. 4), an exhaust part 600 (shown in FIG. 8), and the vortex guide portion 400 (shown in FIG. 4).

The casing 100 includes: a casing body 105 having a space part 130 with empty space therein, the casing body 105 being provided in a substantially columnar shape; an upper open part 110 provided at an open upper part of the casing body 105; and a casing lower surface part 120 covering an open lower part of the casing body 105. The casing lower surface part 120 is provided in a multi-stepped-surface shape so that a center thereof is farther spaced apart from the upper open part 110, as moving toward the center of the casing lower surface part 120. The casing lower surface part 120 includes a first casing stepped surface part 122 positioned along an edge thereof, and a second casing stepped surface part 124 positioned at the center of the casing lower surface part 120 in a state of being integrally connected with the first casing stepped surface part 122 and being provided to protrude downward from the first casing stepped surface part 122.

In addition, a direct water supply part 150 is provided at the lower part of the casing body 105 so that direct water is supplied from the outside into the casing body 105, and a hot-water discharge portion 160 is provided at the upper part of the casing body 105. The direct water supplied into the casing body 105 through the direct water supply part 150 is heated as hot water through the fire tubes 500 to be described later, and the heated hot water is discharged to the outside through the hot-water discharge portion 160.

The firebox 200, the burner 300, the fire tube 500, the exhaust part 600, and the vortex guide portion 400 will be described later with reference to the following drawings.

FIG. 4 is a diagram schematically illustrating an inner part of the hot-water storage type boiler having the vortex guide portion according to the practical exemplary embodiment of the present invention.

Referring to FIGS. 2 to 4, the firebox 200 includes a firebox body 205 provided in a substantially circular columnar shape such that an independent space is provided in an upper part of the space part 130 of the casing body 105 of the casing 100, and a firebox lower surface part 210 covering an open lower part of the firebox body 205. The burner 300 to be described later is inserted into an open upper part of the firebox body 205.

An outer circumference of the firebox body 205 is provided to be smaller than an inner circumference of the casing body 105, so that an empty space, that is, a guide space part 140 (shown in FIG. 8), is provided between the outer circumference of the firebox body 205 and the inner circumference of the casing body 105. When the water supplied into the casing body 105 is heated to be hot water by the fire tubes 500, the heated hot water is guided to the guide space part 140 and then discharged to the outside of the casing body 105. At this time, a spiral guiding part 250 is provided in a spiral shape between the outer circumference of the firebox body 205 and the inner circumference of the casing body 105. The spiral guiding part 250 will be described again with reference to FIG. 7.

The burner 300 is mounted on an upper open part 110 and injects flames into the firebox body 205. Such a burner 300 has a conventional configuration that generates the flames by properly mixing a fuel, for example, such as gas, with air and burning the mixed fuel. When the flames are injected from the burner 300 into the firebox body 205, the firebox body 205 generates a high temperature combustion gas due to the flames.

The fire tube 500 is, for example, is provided in a hollow columnar shape, and a first end part of the fire tube 500 is connected to pass through the firebox lower surface part 210 and a second end part of the fire tube 500 is connected to pass through the casing lower surface part 120. The fire tube 500 may be composed of a plurality thereof and may be disposed radially inside the casing body 105. Also, when the hot combustion gas generated in the firebox body 205 is delivered to the inside of the fire tubes 500, the fire tubes 500 are heated to a high temperature by the heat of combustion gas. Then, the combustion gas which passed the fire tubes 500 is exhausted to the exhaust part 600 to be described later. As such, the fire tubes 500 are heated to a high temperature by the combustion gas generated by the flames of the burner 300, so that the direct water supplied into the casing body 105 is heat-exchanged with the hot water.

The exhaust part 600 is mounted to the casing lower surface part 120 to exhaust the combustion gas, the exhaust gas, and the like, which have discharged from the fire tubes 500.

Figure 5:
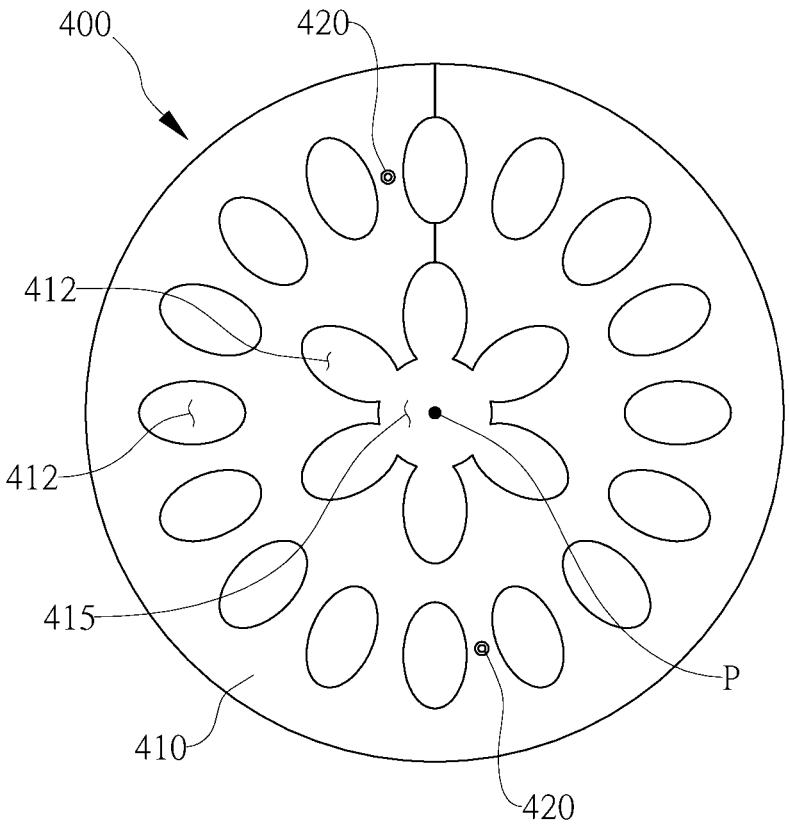
FIG. 5 is a diagram schematically illustrating a front view of the vortex guide portion of the hot-water storage type boiler having the vortex guide portion according to the practical exemplary embodiment of the present invention.
Figure 6:
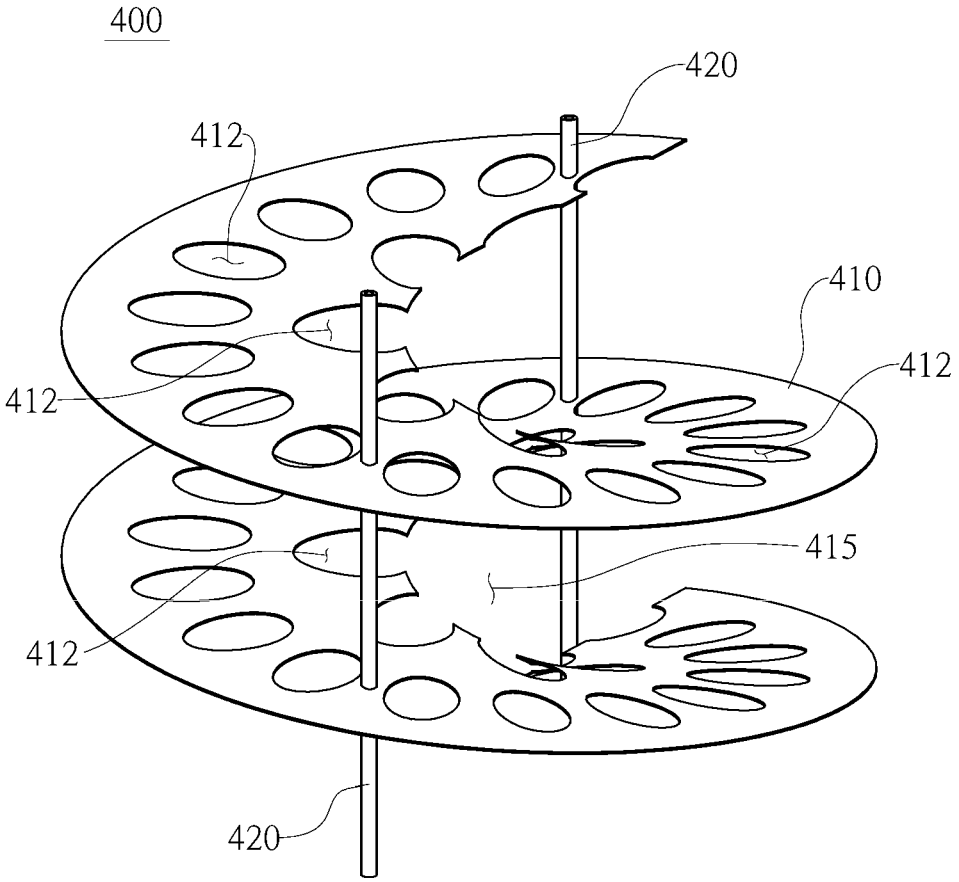
FIG. 6 is a diagram schematically illustrating a top view of the vortex guide portion of the hot-water storage type boiler having the vortex guide portion according to the practical exemplary embodiment of the present invention.

FIG. 5 is a diagram schematically illustrating a front view of the vortex guide portion of the hot-water storage type boiler having the vortex guide portion according to the practical exemplary embodiment of the present invention, and FIG. 6 is a diagram schematically illustrating a top view of the vortex guide portion of the hot-water storage type boiler having the vortex guide portion according to the practical exemplary embodiment of the present invention.

Referring to FIGS. 4 to 6, the vortex guide portion 400 includes a spiral portion 410 and support parts 420. The spiral portion 410 is spirally provided in the space part 130 along a vertical direction of the casing body 105. Here, a central passage part 415 is provided to be elongated in the vertical direction at a center point P positioned in the center of the space part 130, and the spiral portion 410 is provided spirally around the central passage part 415. Here, the central passage part 415 is a space provided integrally with the space part 130, and it is clear that the central passage part 415 is not a separate and independent space. Also, the outer side of the spiral portion 410 is closely adhered to the inner circumference of the casing body 105. In addition, a plurality of fire tube guiding holes 412 is provided at positions correspondingly facing to the fire tubes 500 of the spiral portion 410 so that each of the fire tubes 500 pass through each of the fire tube guiding holes. The plurality of fire tube guiding holes 412 may be disposed radially with the central passage part 415 in the center. In addition, among the plurality of fire tube guiding holes 412, fire tube guiding holes 412 facing the central passage part 415 may be disposed along the edge of the central passage part 415 so that each edge of the fire tube guiding holes facing the central passage part is partially opened in the direction of the central passage part 415.

The support part 420 is provided to be elongated in a bar shape, and is provided in a pair to pass through both sides of the spiral portion 410. Upper sides of the support parts 420 are connected to the firebox lower surface part 210 of the firebox 200, and the lower sides of the support parts 420 are connected to the casing lower surface part 120 while passing through the spiral portion 410 so that the lower sides of the support parts 420 are not laid over the fire tubes 500. Then, the spiral portion 410 is fixed to the support parts 420. At this time, an upper side of the spiral portion 410 is positioned to be spaced apart from the firebox lower surface part 210 of the firebox 200 while being supported by the support parts 420, and the lower side of the spiral portion 410 is positioned to be spaced apart from the casing lower surface part 120 while being supported by the support parts 420. Here, the space 130 is divided into a first space part 132 positioned between the lower side of the spiral portion 410 and the casing lower surface part 120, a second space part 134 positioned between inner side surfaces positioned to face up and down of the spiral portion 410, and a third space part 136 positioned above the upper side of the spiral portion 410. Also, the hot-water discharge portion 160 and the direct water supply part 150 are respectively provided at a position on the upper and lower parts of the casing body 105, having the hot-water discharge portion 160 positioned above the upper side of the spiral portion 410 and the direct water supply part 150 positioned below the lower side of the spiral portion 410.

In addition, the water supplied to inside the space part 130 through the direct water supply part 150, in other words, the direct water, is moved spirally along the spiral portion 410 and moved to the upper side of the space part 130. At this time, the direct water is in contact with the fire tubes 500 for a long time while moving spirally along the spiral portion 410, thereby having an effect that heat exchange efficiency of the fire tubes 500 is improved.

In addition, since the direct water moves spirally along the spiral portion 410 to form a vortex, the water flow moved in the direction of the hot-water discharge portion 160 is maintained uniformly. Accordingly, the water flow with a speed up collides with the firebox lower surface part 210 at a high speed and is then moved to the guide space part 140, thereby the firebox lower surface part 210 having an effect that scale is not accumulated.

In addition, some direct water passes through the central passage part 415, and at this time, the direct water collides with the firebox lower surface part 210 in a state of having the water flow with a speed up. Accordingly, there is an effect that scale is not further accumulated in the firebox lower surface part 210. In addition, the temperature of the water passing through the central passage part 415 is generated to be lower than the temperature of the water moving spirally along the spiral portion 410. This relatively cold water temporarily lowers the temperature of the firebox lower surface part 210 while being in contact with the firebox lower surface part 210. Here, scale tends to be generated more as the temperature of the firebox lower surface part 210 increases, and when the cold water passing through the central passage part 415 as shown in the present invention temporarily lowers the temperature of the firebox lower surface part 210, there is an effect that scale generation is suppressed.

In addition, the spiral portion 410 is positioned at the upper part of the casing lower surface part 120 spaced apart therefrom by the support part 420. Therefore, A third space part 136 is provided between the upper side of the spiral portion 410 and the firebox lower surface part 210 of the firebox 200, and the first space part 132 is provided between a lower part of the spiral portion 410 and the casing lower surface part 120. In addition, the hot-water discharge portion 160 is positioned above the upper side of the spiral portion 410, and the direct water supply part 150 is positioned below the lower side of the spiral portion 410. Accordingly, the direct water supplied into the casing body 105 through the direct water supply part 150 flows into the space between the lower side of the spiral portion 410 and the casing lower surface part 120 and then moves spirally along the spiral portion 410. As such, even though the spiral portion 410 is positioned at the upper part of the casing lower surface part 120 to be spaced apart therefrom, since the direct water supplied into the casing body 105 is moved spirally along the spiral portion 410, the spiral portion 410 does not have to be provided with a long length for coming in contact with the casing lower surface part 120. Accordingly, the present invention may shorten the length of the spiral portion 410, thereby having an effect of reducing unit cost of the product.

Figure 7:
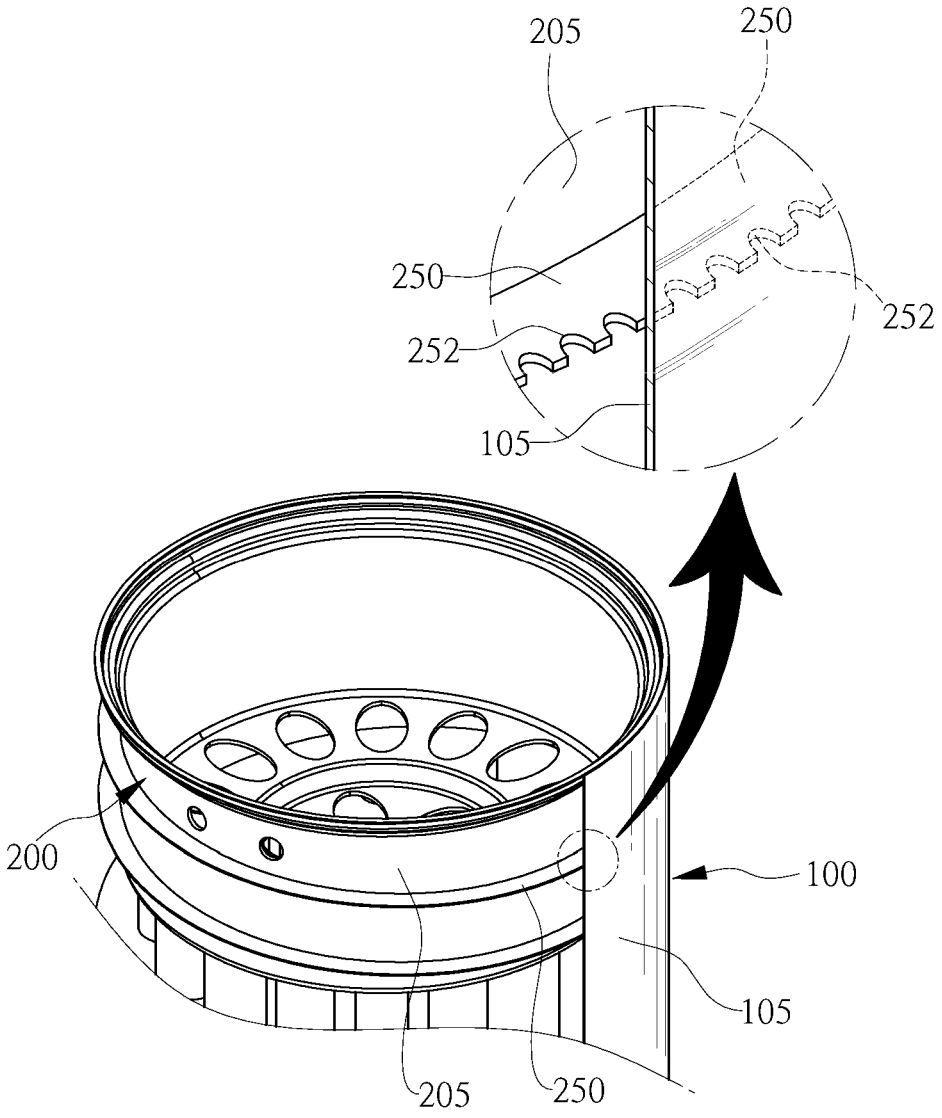
FIG. 7 is a diagram schematically illustrating a spiral guiding part of the hot-water storage type boiler having the vortex guide according to the practical exemplary embodiment of the present invention.

FIG. 7 is a diagram schematically illustrating a spiral guiding part of the hot-water storage type boiler having the vortex guide portion according to the practical exemplary embodiment of the present invention.

Referring to FIG. 7, the spiral guiding part 250 is provided in a spiral shape in the guide space part 140, that is, between the outer circumference of the firebox body 205 and the inner circumference of the casing body 105. Practically, the spiral guiding part 250 is provided in the spiral shape along the outer circumference of the firebox body 205. In addition, the hot water guided to the guide space part 140 is moved spirally around the outer circumference of the firebox body 205 along the spiral guiding part 250 and then discharged to the outside of the casing 100 through the hot-water discharge portion 160. Thus, the hot water guided to the guide space part 140 is configured to move spirally around the outer circumference of the firebox body 205 along the spiral guiding part 250, so that the contact time between the firebox body 205 and the hot water is long, thereby having an effect that the heat exchange efficiency of firebox 200 is improved.

At this time, a plurality of recess parts 252 is further provided to be recessed along the outer longitudinal direction of the spiral guiding part 250 facing the inner circumferential direction of the casing body 105. Therefore, part of the hot water that moves spirally around the outer circumference of the firebox body 205 along the spiral guiding part 250 passes through the spiral guiding part 250 via the recess parts 252. As such, by leaving gaps made by the recess parts 252 in the spiral guiding part 250, the hot water passing through the spiral guiding part 250 through the recess parts 252 is mixed with the hot water moving spirally around the outer circumference along the spiral guiding part 250. Then the hot water having increased to a high temperature while moving spirally around the outer circumference of the firebox body 205 along the spiral guiding part 250 for a long time is mixed with hot water with a low temperature generated not by moving spirally around the outer circumference of the firebox body 205, thereby having an effect of controlling a rapid temperature rise of the hot water. In addition, the spiral guiding part 250 is produced in one piece, thereby improving the work productivity and reducing the production cost.

Figure 8:
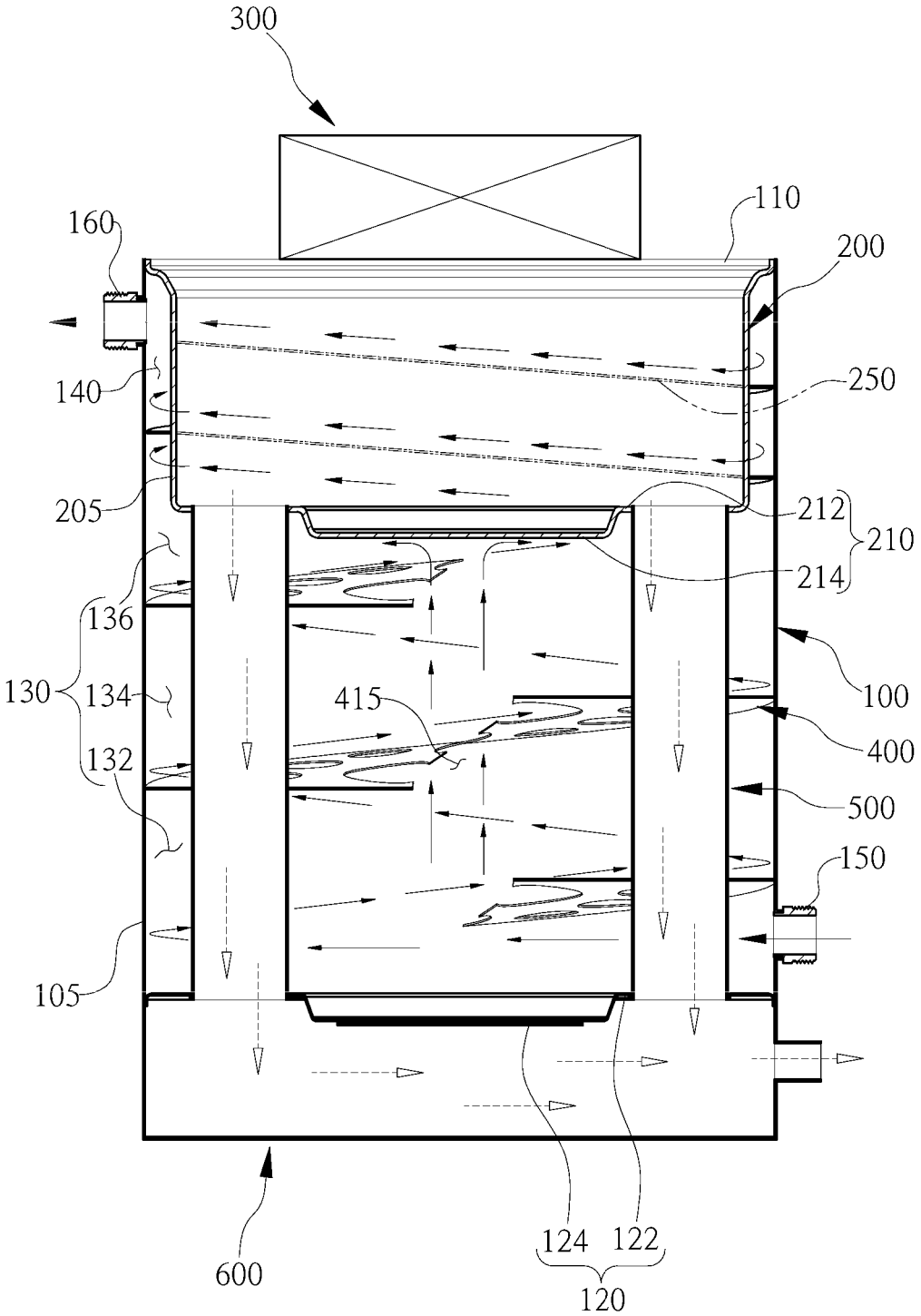
FIG. 8 is a diagram schematically illustrating flow of combustion gas and flow of water of the hot-water storage type boiler having the vortex guide portion according to the practical exemplary embodiment of the present invention.

FIG. 8 is a diagram schematically illustrating flow of combustion gas and flow of water of the hot-water storage type boiler having the vortex guide portion according to the practical exemplary embodiment of the present invention.

Referring to FIGS. 2 to 8, when the burner 300 is ignited, the flames are injected into the firebox body 205, and then a high temperature combustion gas is generated inside the firebox body 205. The combustion gas heats the firebox body 205, and then heats the fire tubes 500 while moving along the inside of the plurality of fire tubes 500. Following that, the combustion gas moves to the exhaust part 600 to be discharged to the outside.

Also, the water is supplied to the first space part 132 inside the casing body 105 through the direct water supply part 150 and then heated by the fire tubes 500. Thereafter, the water is moved along the second space part 134 in the spiral portion 410 or along the central passage part 415. Then, the water is supplied to the third space part 136 and collides with the firebox lower surface part 210. At this time, the water collided with the firebox lower surface part 210 passes through the firebox lower surface part 210 at a high speed, thereby having an effect that scale does not accumulate in the firebox lower surface part 210.

Then, the water passing through the firebox lower surface part 210 is heat-exchanged with the hot water while moving spirally around the outer circumference of the firebox body 205 along the guide space part 140, and the hot water thus generated is discharged to the outside through the hot-water discharge portion 160.

Meanwhile, since the burner 300 is mounted at the center of the upper open part 110, the amount of flames supplied from the burner 300 toward the center of the firebox body 205 is relatively large, whereas the amount of flames supplied from the burner 300 to the edge of the firebox body 205 is relatively small. Accordingly, the temperature of the combustion gas provided from the firebox lower surface part 210 to the fire tubes 500 is also provided in a different temperature depending on the positions on the firebox lower surface part 210. In order to solve this problem, the firebox lower surface part 210 is provided in a multi-stepped-surface shape so as to be spaced apart from the upper open part 110 toward the center thereof. The firebox lower surface part 210 is composed of a first firebox stepped surface part 212 positioned along the edge thereof and a second firebox stepped surface part 214 positioned in the center thereof in a state connected integrally with the first firebox stepped surface part 212 and provided to protrude downward from the first firebox stepped surface part 212. Then, the second firebox stepped surface part 214 is positioned to be spaced farther apart from the upper open part 110 than the first firebox stepped surface part 212, so that a temperature of the combustion gas provided to the fire tube 500 connected with the second firebox stepped surface part 214 and a temperature of the combustion gas provided to the fire tubes 500 connected with the first firebox stepped surface part 212 become similar to each other. Since the temperature of the combustion gas provided to each of the fire tubes 500 is similar, the water filled in the space part 130 of the casing body 105 has the effect that the whole water is heated uniformly. In addition, since the plurality of fire tubes 500 positioned in the casing body 105 is heated uniformly, the lifespan and replacement time for the fire tubes 500 become the same, and thus the maintenance and management of the fire tubes 500 are easy.

In addition, since the casing lower surface part 120 is composed of the first casing stepped surface part 122 and the second casing stepped surface part 124 so as to correspond to the multi-stepped-surface shape of the firebox lower surface part 210, a separation distances between the first and second firebox stepped surface parts 212 and 214 and the first and second casing stepped surface parts 122 and 124 are configured to have the same length, and also the plurality of fire tubes 500 is configured to have the same length with each other. Accordingly, these configurations allows that just one type of the fire tubes 500 may be used, thereby lowering the production cost and improving the product assembly speed and the overall productivity.

Figure 9:
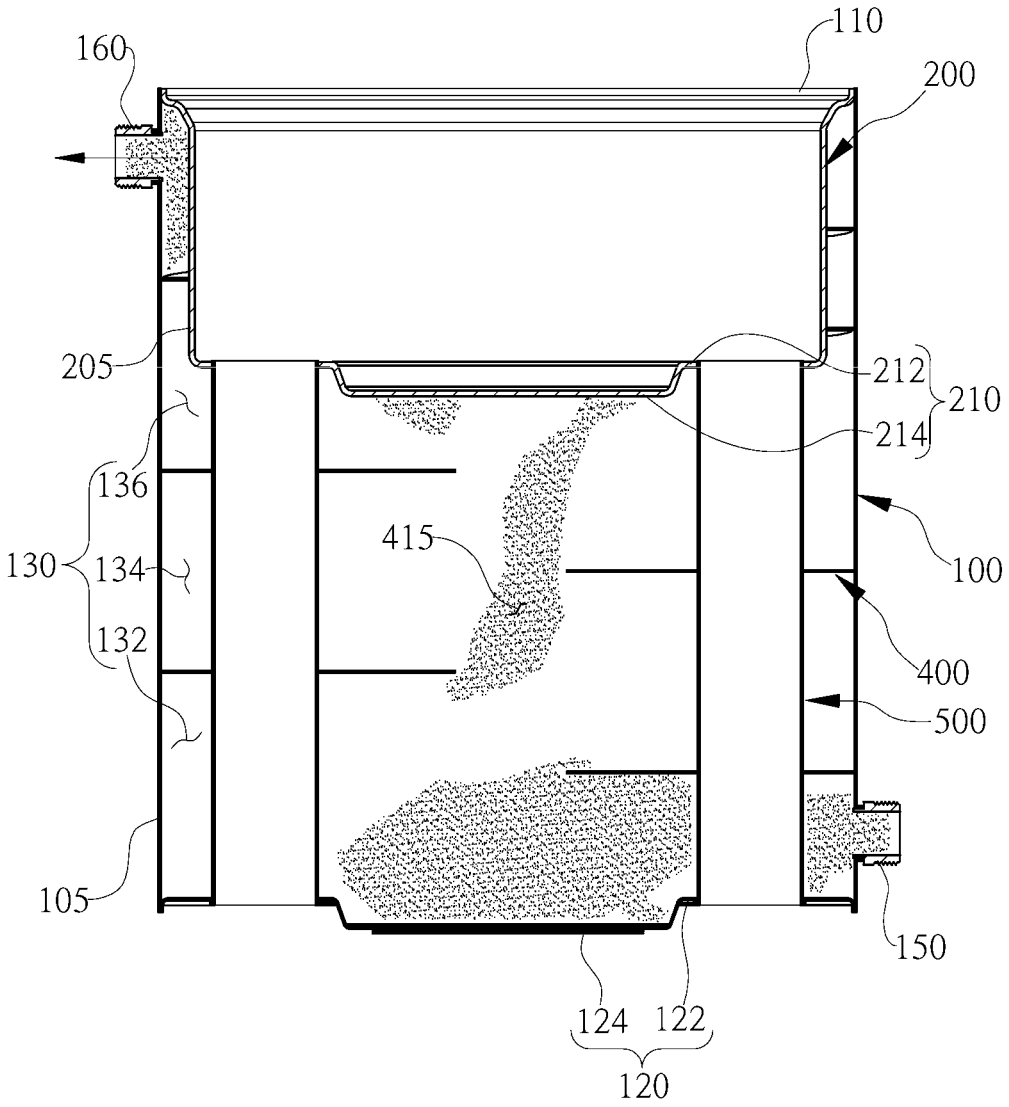
FIG. 9 is a diagram schematically illustrating a speed of water introduced into a casing body of the hot-water storage type boiler having the vortex guide portion according to the practical exemplary embodiment of the present invention.

FIG. 9 is a diagram schematically illustrating a speed of water introduced into a casing body of the hot-water storage type boiler having the vortex guide portion according to the practical exemplary embodiment of the present invention.

Referring to the drawing, the water supplied into the casing body 105 through the direct water supply part 150 may be guided toward the firebox lower surface part 210 while moving spirally along the spiral portion 410. In addition, in FIG. 9, the area with many dotted lines indicates the speed of water. Also, the diagram indicates that the more dotted lines, the faster the speed of water. Referring to this, the water that is guided in the direction of the firebox lower surface part 210 while moving spirally along the spiral portion 410 suppresses the stagnation section to maintain the water flow uniformly, and thus there is an effect of suppressing scale accumulation in the firebox lower surface part 210 even in a region where the hardness of the water is high.

In addition, the water supplied into the casing body 105 through the direct water supply part 150 may be guided in the direction of the firebox lower surface part 210 directly along the central passage part 415. In this case, the water is moved along the narrow central passage part 415 toward the firebox lower surface part 210, thereby increasing the movement speed thereof. As a result, there is an effect that may easily remove scale formed on the firebox lower surface part 210.

The invention claimed is:

1. A hot-water storage type boiler having a vortex guide portion, the hot-water storage type boiler comprising:

a casing having an upper portion in which a fire box is positioned, and a lower portion positioned below the fire box;

a burner configured to inject flames into the firebox;

a plurality of fire tubes positioned within the lower portion of the casing, and having a first side connected to a lower surface of the firebox and a second side extending downward in the lower portion of the casing;

the vortex guide portion having a spiral portion spirally, and positioned within the lower portion of the casing, along a vertical direction of the casing; and an exhaust part provided at a position below the casing and connected to the fire tubes, wherein the flames are configured to be injected by the burner and moved along an inside of the fire tubes while heating the fire tubes and then moved to the exhaust part, and water is configured to be supplied to a first side of the lower portion and moved spirally along the spiral portion and then moved to a second side of the lower portion.

2. The hot-water storage type boiler of claim 1, wherein the spiral portion is provided spirally around a central passage provided in a vertical direction in a center of the lower portion, and the water supplied to a lower part of the lower portion is guided in a firebox direction while moving spirally along the spiral portion or guided in the firebox direction along the central passage.

3. The hot-water storage type boiler of claim 1, wherein an outer side of the spiral portion is in close contact with an inner circumference of the casing.

4. The hot-water storage type boiler of claim 1, wherein the plurality of fire tubes is disposed radially, and the spiral portion is provided with a plurality of fire tube guiding holes to allow the plurality of fire tubes to pass therethrough.

5. The hot-water storage type boiler of claim 1, wherein the vortex guide portion further comprises a plurality of support parts having a first side connected to the lower surface of the firebox, and having a second side connected to a lower part of the casing in a state of passing through the spiral portion so as not to be laid over the fire tubes, and the spiral portion is fixed to the support parts.

6. The hot-water storage type boiler of claim 5, wherein an upper side of the spiral portion is positioned to be spaced apart from the lower surface of the firebox in a state of being supported by the support parts, a lower side of the spiral portion is positioned to be spaced apart from the lower part of the casing in the state of being supported by the support parts, and a hot-water discharge portion and a direct water supply part are respectively provided on upper and lower parts of the casing, in which the hot-water discharge portion is positioned above the upper side of the spiral portion and the direct water supply part is positioned below the lower side of the spiral portion.

7. The hot-water storage type boiler of claim 1, wherein a lower surface part of the firebox facing an upper side of the lower portion is provided in a multi-stepped-surface shape so as to be spaced apart from an upper surface part of the casing toward a center of the lower surface part of the firebox, a lower surface part of the casing facing a lower side of the lower portion is provided in a multi-stepped-surface shape so that a separation distance between the lower surface part of the firebox and the lower surface part of the casing becomes same, upper ends of the fire tubes are configured to pass through the lower surface part of the firebox, and lower ends of the fire tubes are configured to pass through the lower surface part of the casing.

8. The hot-water storage type boiler of claim 1, wherein an outer circumference of the firebox is smaller than the inner circumference of the casing such that a guide space is provided between the outer circumference of the firebox and the inner circumference of the casing, and when the water supplied into the lower portion from an outside is heated to become hot water by the fire tubes, the hot water heated is discharged to the outside of the casing after being guided to the guide lower portion.

9. The hot-water storage type boiler of claim 8, further comprising:

a spiral guiding part having a spiral shape, and positioned along the outer circumference of the firebox, wherein the hot water is configured to be guided to the guide lower portion, and discharged to the outside of the casing after being moved spirally around the outer circumference of the firebox along the spiral guiding part.

10. The hot-water storage type boiler of claim 9, further comprising:

a plurality of recess parts positioned along an outer longitudinal direction of the spiral guiding part facing an inner circumferential surface of the casing, wherein a part of the hot water is configured to be guided to the guide space and discharged to the outside of the casing through the spiral guiding part via the recess parts.

* * * * *